US005701995A

United States Patent [19]

Higuma et al.

[11] Patent Number: 5,701,995

[45] Date of Patent: Dec. 30, 1997

[54] PACKING CASE AND OPENING METHOD THEREFOR

[75] Inventors: Masahiko Higuma, Tohgane; Masami Ikeda; Naohito Asai, both of Yokohama; Tsutomu Abe, Isehara; Toshio Kashino, Chigasaki; Noriyoshi Ohshima, Tokyo; Takeshi Okazaki, Sagamihara; Hitoshi Sugimoto, Yokohama; Hiroki Tajima, Kawasaki, all of Japan

[73] Assignee: Canon Kabushiki Kaisha, Tokyo, Japan

[21] Appl. No.: 716,090

[22] Filed: Sep. 19, 1996

Related U.S. Application Data

[63] Continuation of Ser. No. 247,252, May 23, 1994, abandoned.

[30] Foreign Application Priority Data

| | | | |
|---|---|---|---|
| May 25, 1993 | [JP] | Japan | 5-122621 |
| May 25, 1993 | [JP] | Japan | 5-122946 |
| Sep. 8, 1993 | [JP] | Japan | 5-223489 |

[51] Int. Cl.[6] ..... B65D 25/22; B41J 2/165

[52] U.S. Cl. ..... 206/205; 206/469; 206/461; 383/111; 347/86; 347/108

[58] Field of Search ..... 206/205, 484, 206/1.9, 469, 328, 334, 461, 460; 383/111; 347/108, 86, 87

[56] References Cited

U.S. PATENT DOCUMENTS

| | | | |
|---|---|---|---|
| 2,920,759 | 1/1960 | Carnes . | |
| 3,002,674 | 10/1961 | Wright . | |
| 4,275,835 | 6/1981 | Miksic et al. | 206/205 |
| 4,582,685 | 4/1986 | Guadagno et al. | 206/205 |
| 5,231,416 | 7/1993 | Terasawa et al. | 346/140 R |
| 5,244,092 | 9/1993 | Karita et al. | 206/328 |
| 5,262,802 | 11/1993 | Karita et al. | 347/87 |
| 5,279,410 | 1/1994 | Arashima et al. | 206/328 |

FOREIGN PATENT DOCUMENTS

| | | |
|---|---|---|
| 418828 | 3/1991 | European Pat. Off. . |
| 423374 | 4/1991 | European Pat. Off. . |
| 456840 | 11/1991 | European Pat. Off. . |
| 62-019460 | 1/1987 | Japan . |
| 812278 | 4/1959 | United Kingdom . |
| WO86002909 | 5/1986 | WIPO . |
| WO88000561 | 1/1988 | WIPO . |

*Primary Examiner*—M. D. Patterson

*Attorney, Agent, or Firm*—Fitzpatrick, Cella, Harper & Scinto

[57] ABSTRACT

A package material for accommodating a container cartridge provided with an ink supply portion integral with a recording head in use includes a package material for accommodating the container cartridge, provided with opening means for permitting opening of the package material; a sealing material for sealing an ink supply portion of the container cartridge; wherein the sealing member is at least partly mounted to the package material.

11 Claims, 12 Drawing Sheets

PACKING CASE AND OPENING METHOD THEREFOR

This application is a continuation of application Ser. No. 08/247,252 filed May 23, 1994, now abandoned.

FIELD OF THE INVENTION AND RELATED ART

The present invention relates to a packing case and an opening method therefor for an exchangeable ink cartridge for containing ink to be supplied to a recording head, the container being detachably mounted to an ink jet recording head. Types of ink cartridge detachably mountable relative to an ink jet recording apparatus are classified into two groups. In one of them, it is connected with a recording head fixedly mounted on a recording apparatus, through a flexible tube, and it is detachably mountable to the recording apparatus. In this type, a flexible generally flat bladder is accommodated in a casing of plastic material, and the bladder is provided with a jointing portion of an elastic material for supplying the ink out. The ink is contained in the sealed bladder. Such an ink cartridge can be put on market or transported without paying particular attention to the structure of a package therefor.

In a second type, an ink cartridge is integrally constituted by a recording head and an ink container, and the integral ink cartridge is detachably mountable to an apparatus as a unit. This type is used, since downsizing is possible.

An ink cartridge, generally, is provided with an ink absorbing material, and is provided with an air vent for fluid communication between the inside of the ink container and the outside thereof to permit supply of the ink therein. The recording head is provided with an ink ejection outlet or outlets, and therefore, the possibility that the ink leaks out through the ink ejection outlet or the air vent, is not avoidable.

In order to prevent the ink leakage during the transportation of the ink cartridge, both of the ink ejection outlet and the air vent or only the ink ejection outlet when the air vent has a structure for preventing the ink leakage, is sealed by an elastic material or an adhesive sealing tape. It is contained in a rigid casing, and an opening of the casing is covered with a covering member having a property of preventing water introduction. Then, it is packaged and put on the market. When the sealing tape is used, the portion of the sealing tape sealing the air vent is first opened, and only then, the sealing tape portion for the ink ejection outlet is removed preferably, to assure the safe removal of the sealing tape in case that the internal pressure of the ink container is increased due to ambient condition change (pressure change or temperature change) or due to the transportation thereof.

Recently, for the purpose of downsizing and inexpensive ink replenishment (consuming material), and for the purpose of effective use of a recording head having a relatively long service life, a separable head cartridge and container cartridge has been proposed in which the ink container and the recording head are separable from each other.

Referring to FIG. 1, there is shown such an ink container cartridge of this type.

An outer wall of the container cartridge 1 is provided with an ink supply port 2 for supplying the ink to a recording head 11. When an ink supply tube 12 is connected with an ink supply port 2, a liquid passage is established between the ink container cartridge 1 and the recording head 11. In another case, the ink supply port and the ink supply tube 12 are connected with an unshown connecting tube.

An air vent 3 is formed through an outer wall of the ink container cartridge 1 to permit introduction of the air thereinto. The inside of the ink container 1 is filled with an ink retaining material 4. By a proper ink retaining power of the retaining material, the leaking of the ink through the recording head 11 is prevented, while permitting the proper ink supply to the recording head. Examples of the material of the ink retaining material 4 include felt, porous material having continuous pores, or the like. Particularly, it is preferable to use sponge of polyurethane foam or the like because it is easy to adjust the ink retaining power.

The ink supply port 2, and preferably the air vent 3 also, are required to be hermetically sealed to prevent ink leakage or ink evaporation until it is connected with the ink supply tube 12 of the recording head 11 for use, that is, during the transportation or storage thereof before the use thereof. For the purpose of this sealing, a sealing tape 5 is generally used. For example, the sealing tape 5 is a barrier material (so-called in the field of packing). A material similar to the body of the container cartridge 1 is used as a bonding layer for the barrier material, so that the bonding layer is fused to increase the sealing property. This is preferable.

FIGS. 2A and 2B illustrate prior art of the sealing of the ink supply port 2 using a sealing tape 5. FIG. 2A is a perspective view illustrating a sealing tape 5 and a wall la of the container cartridge 1 which has the ink supply port 2. FIG. 2B is a sectional view of the ink supply port 2 in the state that it is sealed by the sealing tape 5.

In FIG. 2B, between the sealing tape 5 and the ink retaining material 4, there is a gap $t_0$ corresponding to the thickness of the wall of the container cartridge 1, in the ink supply port 2. Therefore, upon ambient condition change, vibration imparted thereto, or change with time, or the like during the transportation of the container cartridge 1, the ink retained by the ink retaining material seeps out into the gap and stagnates there. If this occurs, the stagnated ink scatters outwardly when the sealing tape 5 is removed for the purpose of using the container cartridge 1. Then, the fingers or the cloths of the operator will be contaminated. In addition, the scattered ink is wasted. In addition, even if the ambient condition change or the change with time is less, the shock upon the removal of the sealing tape 5, or pressing by the fingers to the container cartridge 1 upon the removal of the sealing tape 5, may result in the scattering of the ink. In order to avoid this, the removal operation of the sealing tape 5 has to be carried out with quite high care, thus deteriorating the operativity.

If the structure of the ink container cartridge described hereinbefore is used as the structure of the container cartridge, there arises a problem from the standpoint of the ink supply to the recording head (it is difficult to produce a desired negative pressure). In addition, the structure of the ink supply port becomes bulky with cost increase.

SUMMARY OF THE INVENTION

It is a yet further object of the present invention to provide an ink container cartridge with which the quantity of the ink scattered or discharged out of the container cartridge through an opening or openings of the cartridge is small when the opening or openings are unsealed.

Accordingly, it is a principal object of the present invention to provide a packing case and an opening method therefor with which ink scattering from the ink supply port is avoided upon the removal of the ink sealing tape, thus facilitating the removing operation of the sealing tape.

It is another object of the present invention to provide a container cartridge packing case which is reliable during transportation alone.

It is a further object of the present invention to provide a packing case for a container cartridge having a simple configuration and simple structure in the connecting portion between an ink jet recording head and a container cartridge, and which does not obstruct downsizing of the ink jet recording apparatus.

According to an aspect of the present invention, there is provided a package material for accommodating a container cartridge provided with an ink supply portion integral with a recording head in use, comprising: a package material for accommodating the container cartridge, provided with opening means for permitting opening of the package material; a sealing material for sealing an ink supply portion of the container cartridge; wherein the sealing member is at least partly mounted to the package material.

According to another aspect of the present invention, there is provided a method of opening a package accommodating a container cartridge provided with an ink supply portion which is integral with a recording head in use, comprising: exposing only a part of the container cartridge by opening the passage; removing a sealing member which is integral with a packing material by taking the container cartridge out of the package material.

According to a further aspect of the present invention, there is provided an ink container cartridge having a small volume of a space in which the ink can occupy and from which the ink scatters upon unsealing the cartridge.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings.

Figure 3:
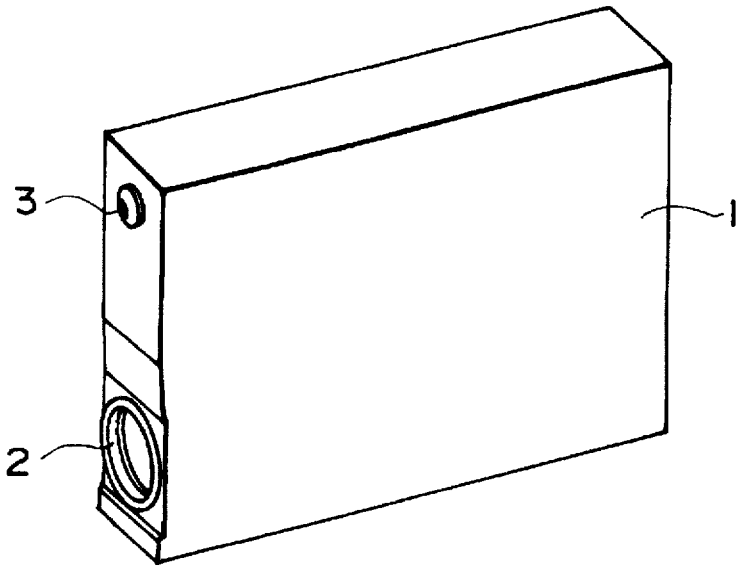
FIG. 3 shows an example of a container cartridge.

FIG. 3 is a perspective view of an exchangeable container cartridge 1 to which the present invention is applied.

As shown in FIG. 3, the container cartridge is provided at least with an ink supply port 2 for connection with an unshown ink supply tube of an ink jet recording head, and an air vent 3 for permitting introduction of the air required for the ink to be supplied out from the container cartridge 1.

The present invention is applicable to a container cartridge 1 if it is provided with at least two openings such as an ink supply port 2 and an air vent 3, irrespective of the structure in the container cartridge 1. Accordingly, it may be a container cartridge integral with an ink jet recording head and containing porous ink retaining material in the entirety of the ink container, a container cartridge containing only ink therein, and a container cartridge in the form of a combination of the above two, which, for example, comprises an opening for connection with an ink jet recording head, a negative pressure generating material accommodating portion for accommodating a negative pressure generating material (ink absorbing material), an ink accommodating portion adjacent to the negative pressure generating material and connected therewith at a bottom. However, the present invention is suitably applicable to an ink cartridge having a negative pressure generating material accommodating portion and an ink accommodating portion.

Figure 4A:
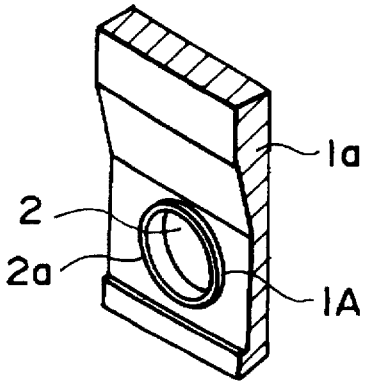
FIGS. 4A and 4B respectively illustrates a configuration of an ink supply port in a container cartridge and sealing for an ink supply port by a sealing material.
Figure 4B:
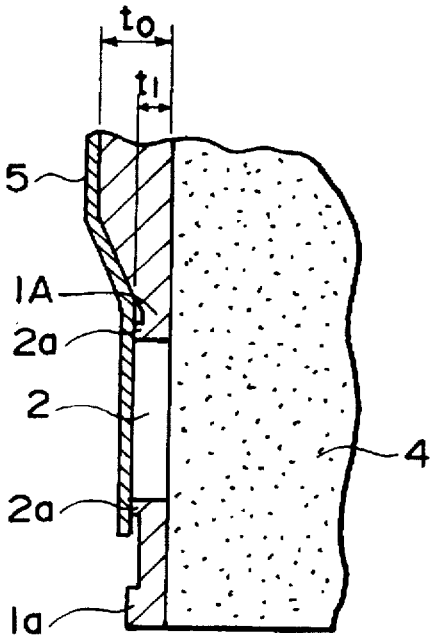

FIGS. 4A and 4B illustrate an ink container cartridge according to a first embodiment of the present invention. FIG. 4A is a perspective view of such a wall of the container cartridge as is provided with an ink supply port 2. FIG. 4B is a sectional view of the ink supply port 2 which is hermetically sealed by a sealing tape (material) 5. Designated by a reference la is a part of the wall provided with the ink supply port 2 in the container cartridge.

In this embodiment, as shown in FIG. 4B, the portion around the ink supply port 2 is provided with a thin wall portion 1*a*, so that the thickness of the container cartridge wall $t_1$ is smaller than that $t_0$ of a conventional wall of FIG. 3. Therefore, the gap between the sealing tape 5 and the ink retaining member 4 at the ink supply port 2 is $t_1$, and therefore, a volume of the space formed there is $t_1/t_0$, as compared with the conventional volume, thus reducing the volume of the space in which the ink from the ink retaining material 4 can stagnate. Therefore, the quantity of the ink stagnating there can be reduced to such an extent that the quantity of the ink scattered upon the removal of the sealing tape 5 does not result in contamination. Additionally, the waste of the ink can be avoided. In other words, the sealing tape 5 can be easily removed, thus improving the operativity.

Normally, the container cartridge is manufactured by molding a plastic material. In this case, there exists a proper wall thickness (basic wall thickness) for permitting proper molding. It is different if the material is different. For this reason, it is not preferable to reduce the thickness $t_1$ too much. However, by reducing it as much as possible, the above described object can be accomplished.

Another configuration other than that shown in FIG. 4 is usable to reduce the wall thickness of the ink container. The cross-section of the ink supply port 2 may be other than circular which is shown in FIG. 4.

Figure 5A:
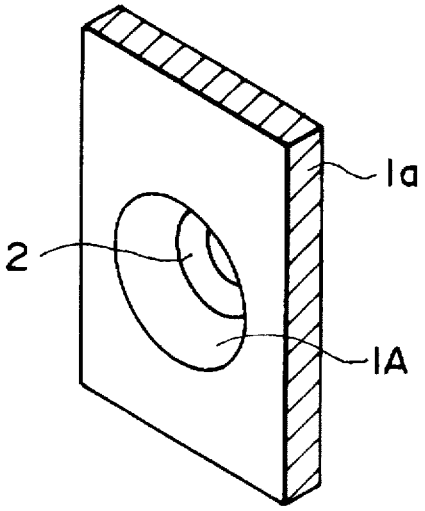
FIGS. 5A and 5B respectively show another example of a configuration of an ink supply port in a container cartridge and sealing for an ink supply port by a sealing material.
Figure 5B:
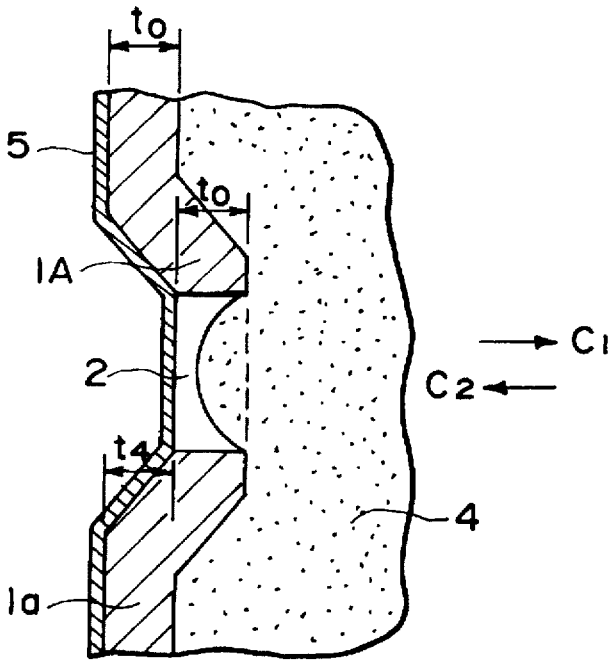

In this embodiment, the periphery of the ink supply port 2 is projected into a rib 2*a*. By doing so, the bonding of the sealing tape 5 is assured so as to prevent leakage of the ink through the bonding surface. The rib may be formed similarly around the air vent 3. FIG. 5 illustrates a container cartridge according to another embodiment. FIG. 5A is a perspective view of a wall portion of the container cartridge provided with the ink supply port 2. FIG. 5B is a sectional view of an ink supply port 2 which is sealed by a sealing tape 5. Designated by a reference 1*a* is a part of a wall provided with the ink supply port 2.

Figure 1:
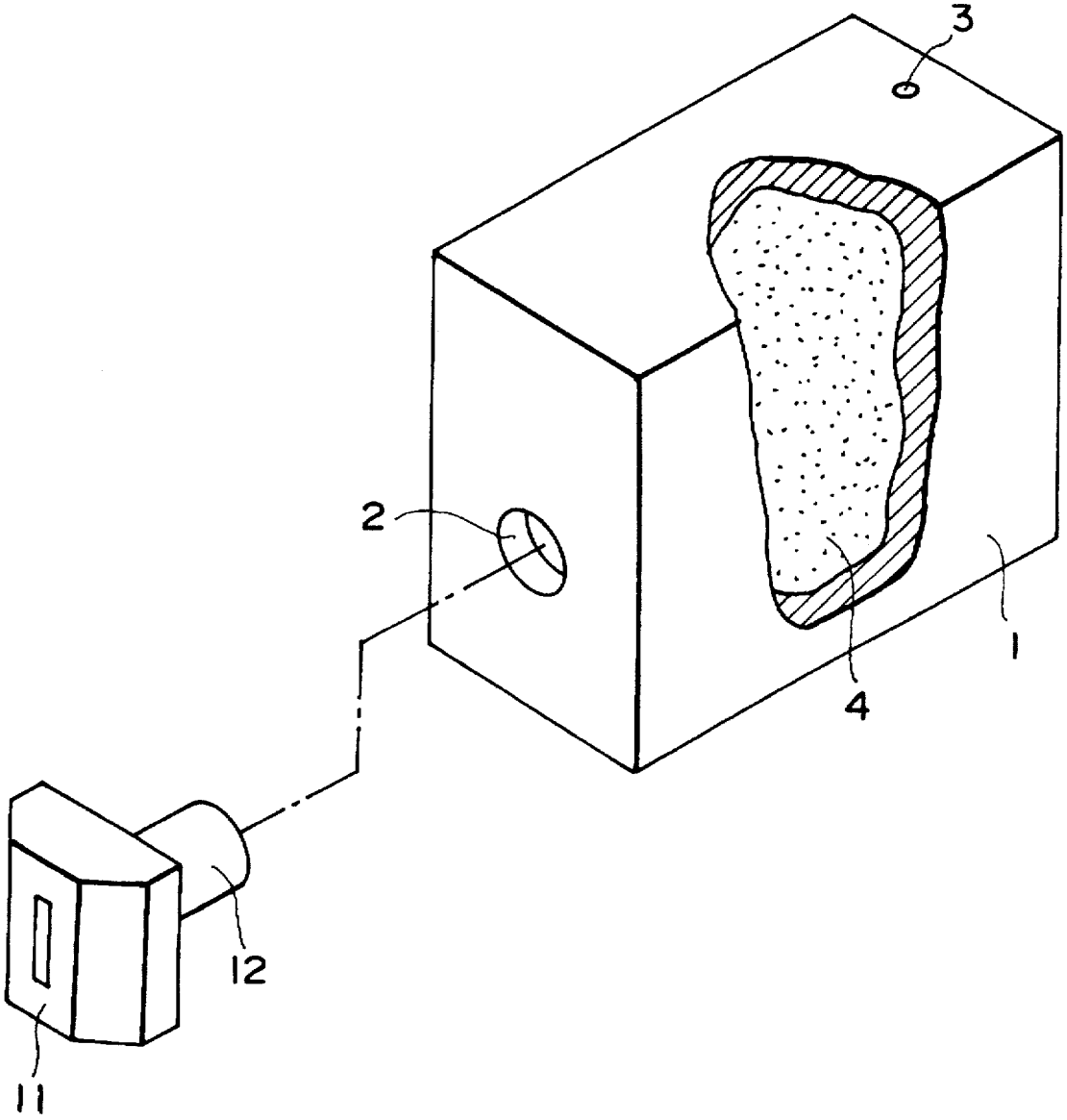
FIG. 1 is a perspective view of an example of a head cartridge and a container cartridge.
Figure 2A:
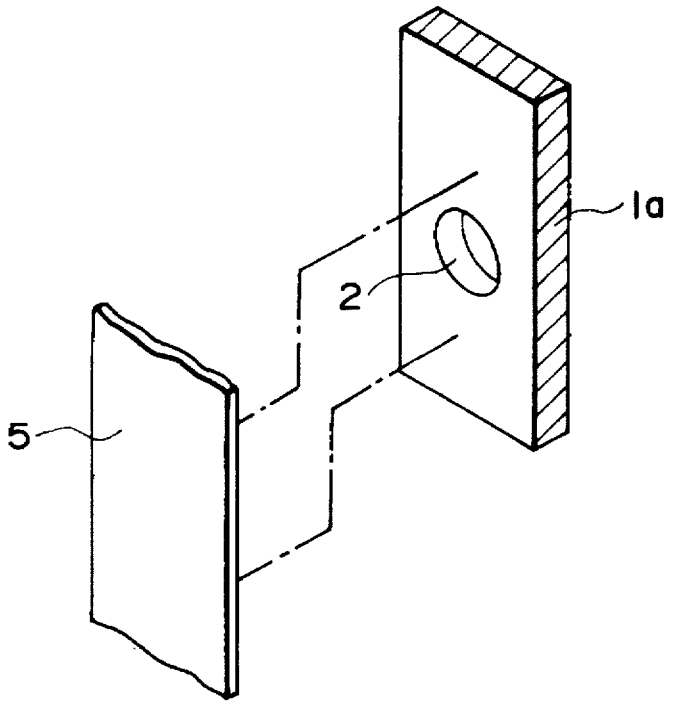
FIGS. 2A and 2B illustrate a configuration of an ink supply port in a conventional ink container and a sealing for the ink supply port using a sealing tape.
Figure 2B:
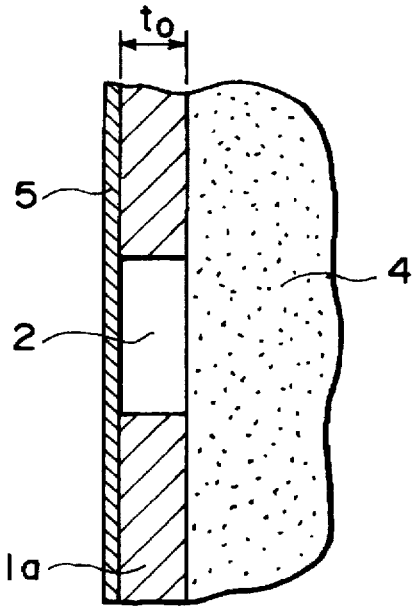

In this embodiment, as shown in FIG. 5B, the peripheral portion of the ink supply port 2 is recessed into the container cartridge 1 (1A), so that the wall 1*a* is recessed into the inside by a thickness $t_4$. By this, the ink retaining material 2 is compressed in a direction of an arrow C1 by the recess 1*a* of the container cartridge wall. Thus, the ink retaining material bulges by its elasticity toward the space in the ink supply port 2 in the direction of an arrow C2. In this manner, the space formed the sealing tape 5 and the ink retaining member 4 in the ink supply port 2 is partly occupied by the ink retaining material 4, so that the volume of the space is reduced as compared with the conventional example shown in FIG. 2. Accordingly, the volume of the space in which the ink from the ink retaining material 2 can stagnate, can be reduced.

The degree $t_4$ of the recess of the container wall is properly determined by one skilled in the art in accordance with the size of the ink supply port 2 and the elasticity of the ink retaining material 4, with the view to reducing the volume as much as possible.

The configuration of the recess is not limited to that shown in FIG. 5. In addition, the cross-section of the ink supply port 2 may be other than circular, which is shown in FIG. 5.

Figure 6A:
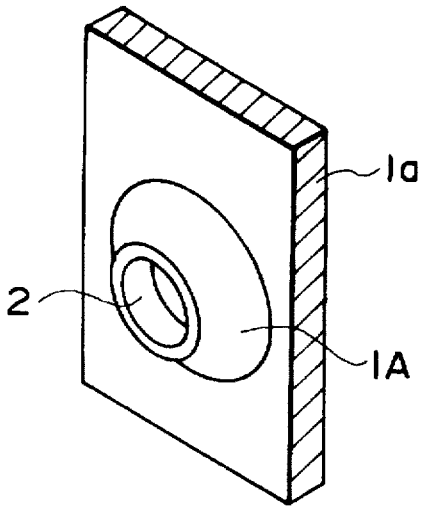
FIGS. 6A and 6B respectively shows a configuration of an ink supply port in a container cartridge and sealing for an ink supply port by a sealing material, in a further example.
Figure 6B:
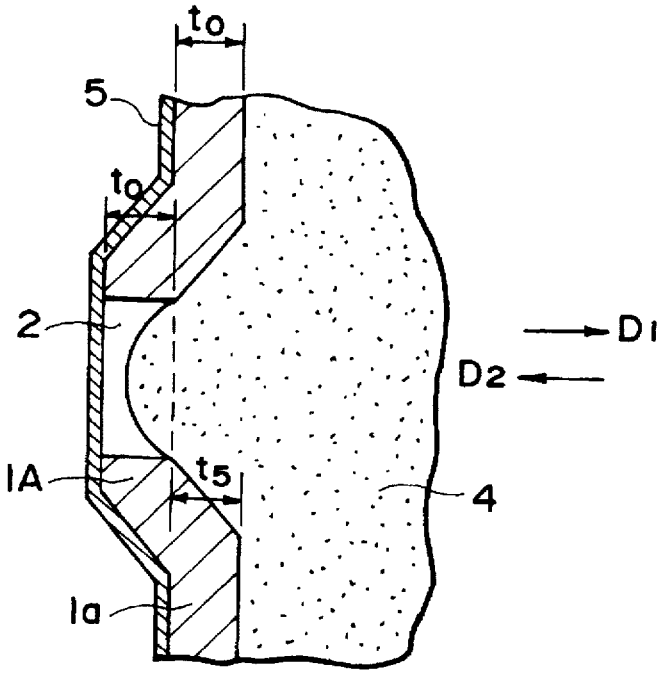

FIG. 6 illustrates an ink container according to a further embodiment of the present invention. FIG. 6A is a perspective view of a wall portion of the ink container provided with the ink supply port 13. FIG. 6B is a sectional view of the ink supply port 13 which is sealed by a sealing member 16. Designated by a reference numeral 51 is a part of the wall provided with the ink supply port 13.

As shown in FIG. 6B, in this embodiment, there is provided a projected portion 1*a* projected outwardly, at the periphery of the ink supply port 2. The degree of projection is indicated by $t_5$. The size of the ink retaining material 4 measured in a direction of an arrow D2 is such that it extends beyond an inside surface of the container by not less than $t_5$. The ink retaining material is compressed in a direction D1, and therefore, the elasticity thereof provides such a configuration that it is bulged in a direction D2 toward the space in the ink supply port 2. In this manner, the ink retaining material 4 partly occupies the space formed between the sealing tape 5 and the ink retaining material 4 in the ink supply port 2, so that the volume in the space is reduced as compared with the conventional example of FIG. 2. Thus, the space permitting ink stagnation can be reduced.

The degree of projection $t_5$ of the ink container wall is properly determined by one skilled in the art in accordance with degree of compression in the direction D1 and the elasticity of the ink retaining material 4 and a size of the ink supply port 2, with the view to reducing the volume of the space as much as possible.

The configuration of the projection 1*a* may be other than shown in FIG. 6. In addition, the configuration of the ink supply port 2 may be non-circular, although circular example is shown in FIG. 6.

The above-described embodiments may be combined properly if the volume of the space in the ink supply port 2 can be reduced.

In the following, the description will be made as to embodiments of packing cases which can avoid contamination with ink upon unsealing.

Figure 7:
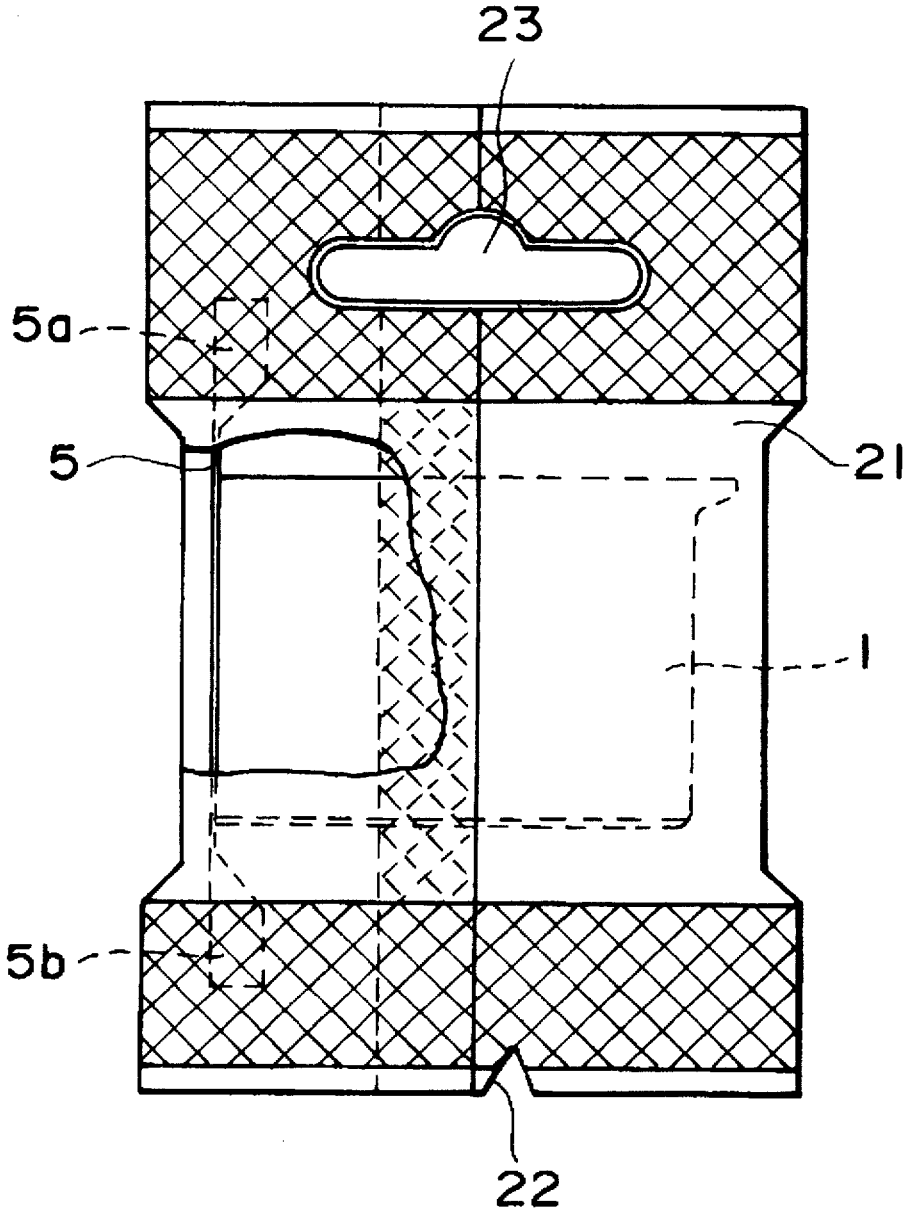
FIG. 7 illustrates an example of a packing case containing a container cartridge.

FIG. 7 illustrates a container cartridge packing case according to an embodiment of the present invention. The openings 2 and 3 of the container cartridge 1 are sealed by a sealing tape 5. A fusing layer of the sealing tape 5 and a fusing layer of the packing material 21 are fused together by heat at portions indicated by 5*a* and 5*b*. The hatched portions in this Figure are portions of the packing case which are bonded together or another material. The packing case or material 21 is provided with a notch and a hole 23 engageable with a hook in a shop. The sealing tape and at least two openings of the container cartridge 1 may be bonded by pressure, adhesive material, fusing and/or combination thereof, provided that the sealing is enough to prevent evaporation of the ink in the container cartridge and to endure against expansion of the air or ink therein. From the standpoint of high reliability, fusing type is preferable.

As for the sealing tape 5, a single layer barrier (so-called in the field of package) or a multi-layer barrier is preferably used. It is further preferable that the fusing layer of the sealing tape may be of the same or similar material as the main body of the container cartridge and/or the connecting portion of the package material. Another sealing tape material such as paper is usable, provided that the sealing is possible by pressure, bonding or fusing.

Figure 8:
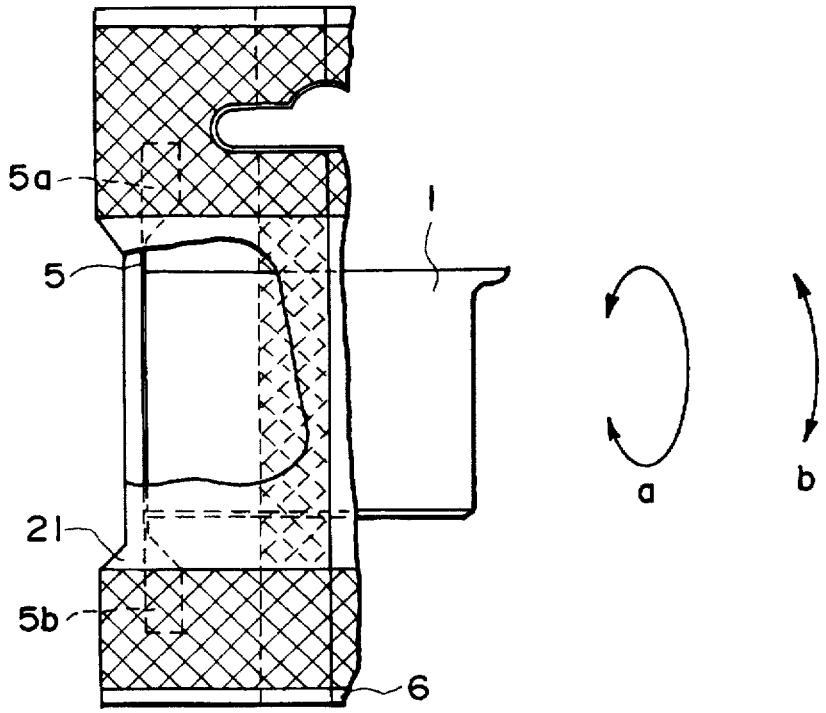
FIG. 8 illustrates an example in which a packing case is opened.

The package material shown in FIG. 7 is opened by tearing from the notch 6, as shown in FIG. 8 (first opening step). By this, non-sealed portion of the container cartridge (without the sealing tape 4) is exposed. As a second opening step, partly exposed is separated from the package material 21. Upon this separation, it is preferable that the container cartridge 1 is rotated in a direction indicated by arrows a and b. Alternatively, the container cartridge may be pulled off the package material by one hand with the upper part of the package material 21 adjacent the sealing tape 5 being nipped by the fingers of the other hand. By doing so, the ink supply port 2 and the air vent 3 of the container cartridge is unsealed, to permit the container cartridge 1 to be taken out of the package.

In this embodiment, the non-seal portion of the container cartridge is exposed by the first step of the opening action. It should be noted that the container cartridge is, in effect, connected with the packing material 21 by the sealing tape 5, and therefore, the container cartridge does not pop out of the package material 21 by the first opening step. For this reason, contamination can be prevented even if the container cartridge is let fall thereafter. It is not until after the second opening step that the container cartridge is taken out. In addition, when the sealing tape 5 is removed from the opening of the container cartridge, the openings 2 and 3 of the container cartridge are still within the package material. Therefore, even if the ink exists in the openings 2 and 3, the ink scatters only into the package material so that the result is only the contamination of the inside of the package material, without contamination of the operator's hand or wear. By the reduction of the space in the ink supply port 2, the amount of the scattered ink can be reduced.

Figure 9:
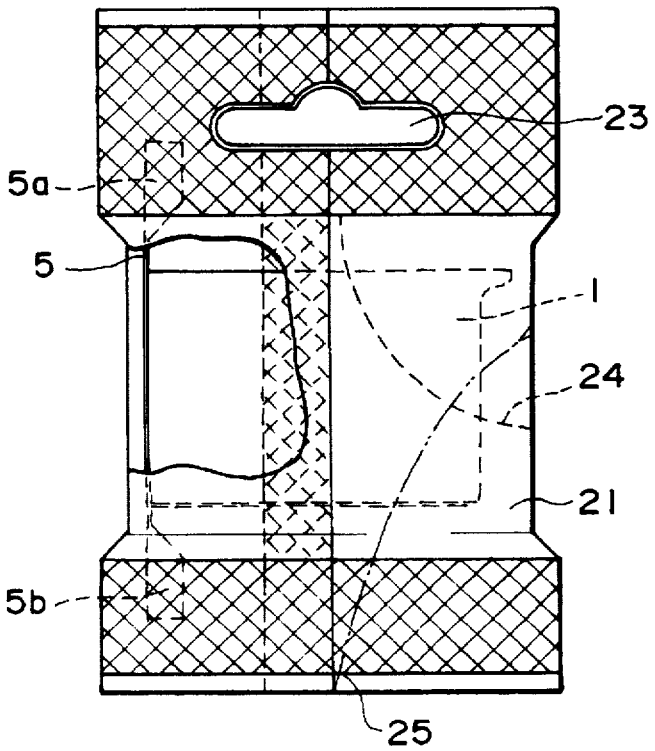
FIG. 9 illustrates another example of a packing case containing a container cartridge.
Figure 10:
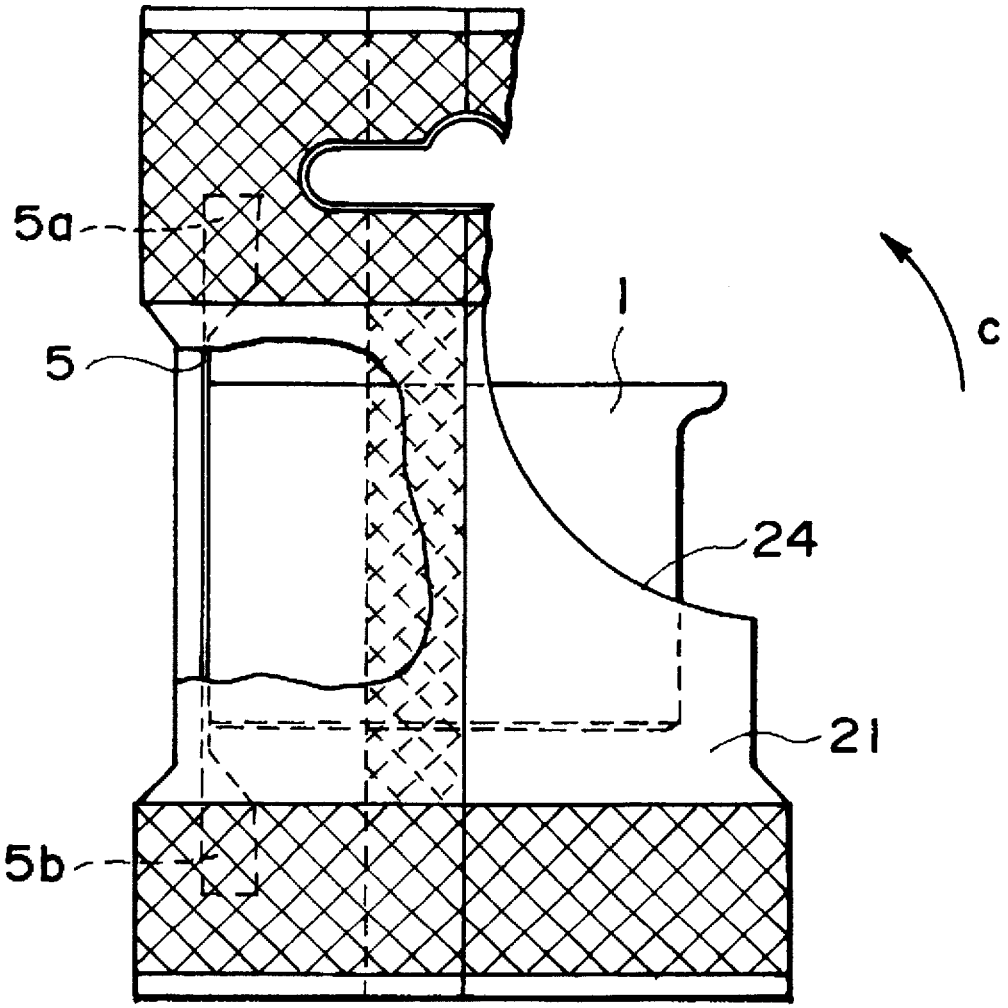
FIG. 10 illustrates another example in which the packing case is opened.

In an embodiment of FIG. 9, the package is perforated at 24. According to this embodiment, the first opening step is facilitated, and it is assured that the first step of the opening results in exposing only a corner portion of the container cartridge. Then, in the second step, the exposed corner portion of the container cartridge is nipped, and a lower portion of the package is nipped by fingers of the other hand, and thereafter, the cartridge is rotated in a direction indicated by an arrow c. As will be understood, the opening provided by the perforation 24 assures the rotational direction (c) when the cartridge is taken out of the package. In this manner, the liability of popping out of the cartridge in the first step can be assuredly prevented.

Figure 11:
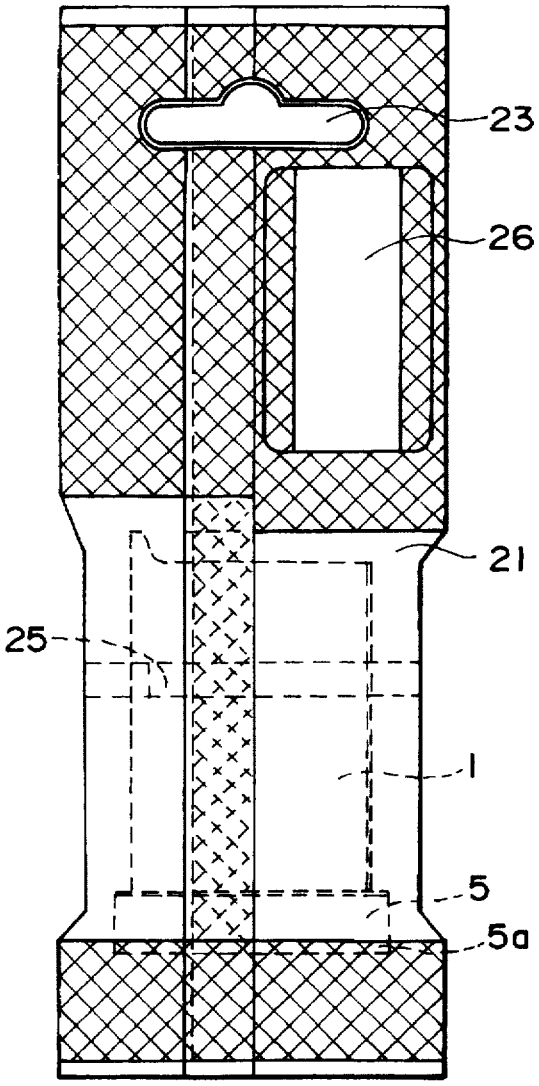
FIG. 11 illustrates a further example of a packing case containing a container cartridge.

When the direction of rotation upon the taking out of the container cartridge is limited in this manner, the sealing tape is first removed from the ink supply port 2, and thereafter, it is removed from the air vent 3. Since the size of the air vent 3 is generally smaller, the scattering of the ink from the ink supply port 2 can be further reduced because the first release of the air vent 3 provides the atmospheric pressure with the inside of the ink container, and therefore, the atmospheric pressure is established in the ink container when the ink supply port 2 is released from the sealing tape. This advantageous effect is assured by the manner of the perforation formed in the package, in this embodiment. Referring to FIG. 11, there is shown a package according to another embodiment of the present invention.

In this embodiment, one side 5*a* of the sealing tape 5 is fused along one side of the packing material 21. For easy opening of the packing material 21, a tear tape 25 is bonded or fused on one complete circumferential inside surface of the packing material 21. The position of the tear tape 25 is such that when the package is opened about one half of the cartridge 1 is exposed so as to permit easy handling by the operator. An end of the tear tape 25 projects out for the easy operation. Designated by 26 is a printed portion for an identification mark such as bar code or the like on the package material.

In FIG. 11, when the package is hang up on a hook using the opening 23, the air vent 3 and the ink supply port 2 of the container cartridge sealed by the sealing tape 5 are positioned downward. By this positioning, the ink in the container is urged by the gravity toward the ink supply port 2 so that the ink is retained adjacent the ink supply port 2 to permit initial proper ink supply when the cartridge is mounted to the recording head.

Figure 12:
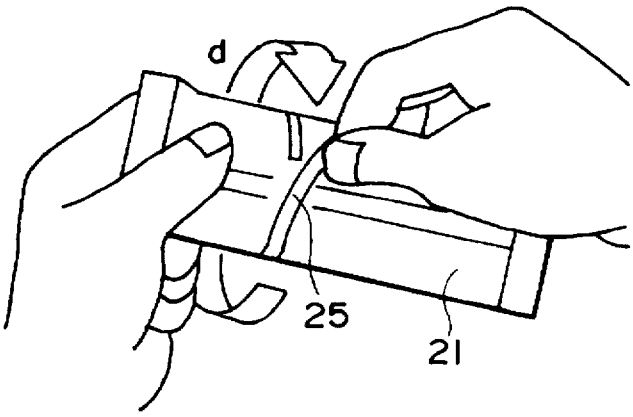
FIG. 12 is a perspective view illustrating a method of opening the packing case of FIG. 11.
Figure 13:
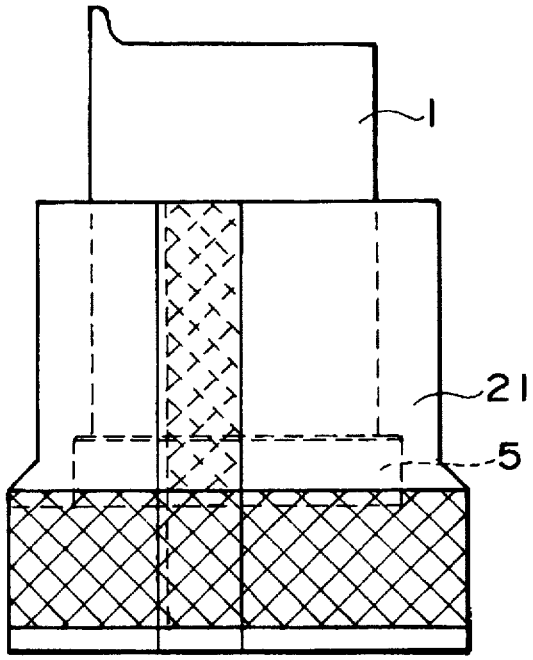
FIG. 13 illustrates the packing case of FIG. 11 when it is opened.
Figure 14:
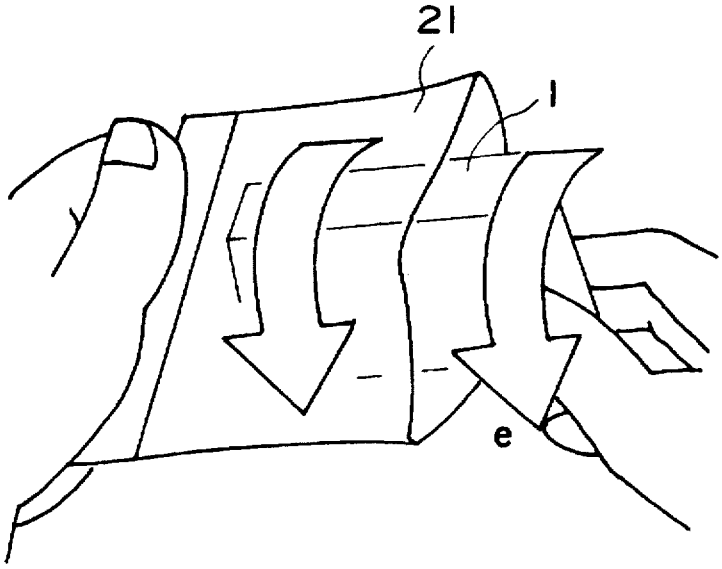
FIG. 14 illustrates the packing case of FIG. 11, from which the ink cartridge is being taken out.

FIG. 12 illustrates the opening operation. By removing the tear tape 25 in a direction d, the package is opened. With this state, as shown in FIG. 13, a part of the cartridge 1 is exposed. Thus, the first stage of the opening becomes easy without imparting undesirable vibration or the like to the container cartridge. In the second opening step, a portion of the package material 21 where the sealing tape 5 is fused, is nipped by the fingers of one hand, and the exposed portion of the cartridge is nipped by the fingers of the other hand, and the cartridge is rotated in a direction e, as shown in FIG. 14. Similarly to the other embodiment, the sealing tape 5 is removed from the ink supply port 2 and the air vent 3 of the container cartridge 1, so that the container cartridge can be taken out of the package 21. By taking out the container cartridge while rotating it, strong impact to the ink supply port 2 can be avoided, and therefore, the ink leakage can be effectively prevented. Even if the ink is scattered, it is scattered only in the package 21, and therefore, there occurs no problem of contamination to the operator. Even if the container cartridge is taken out only by pulling it without the rotational motion, the ink scatters only into the package material, and therefore, no practical problem arises.

In order to prevent leakage of the ink to the outside of the package upon an unexpected situation during the transportation in which the ink leaks out into the package, it is preferable that the package is hermetically sealed. However, from the standpoint of preventing expansion of the package under a reduced pressure upon ambient condition change, the hermetical sealing is not desirable, but it is desirable that the inside of the package is partly opened to the atmosphere. The distribution of the ink in the container cartridge is such that it is dense adjacent the ink supply port 2 to assure the ink supply to the recording head so that as small as possible amount of the ink is present adjacent the air vent 3. Therefore, it is preferable that when the sealing type is removed from the container cartridge, it is preferable that it is removed first from the air vent 3. When the internal pressure of the container cartridge 1 sealed by the tape 5 is high due to the ambient condition (temperature and pressure change), the opening of the air vent 3 having a smaller opening area than the ink supply port 2 provides the atmospheric pressure with the inside of the ink cartridge, thus properly preventing the ink discharge through the ink supply port 2.

Figure 15:
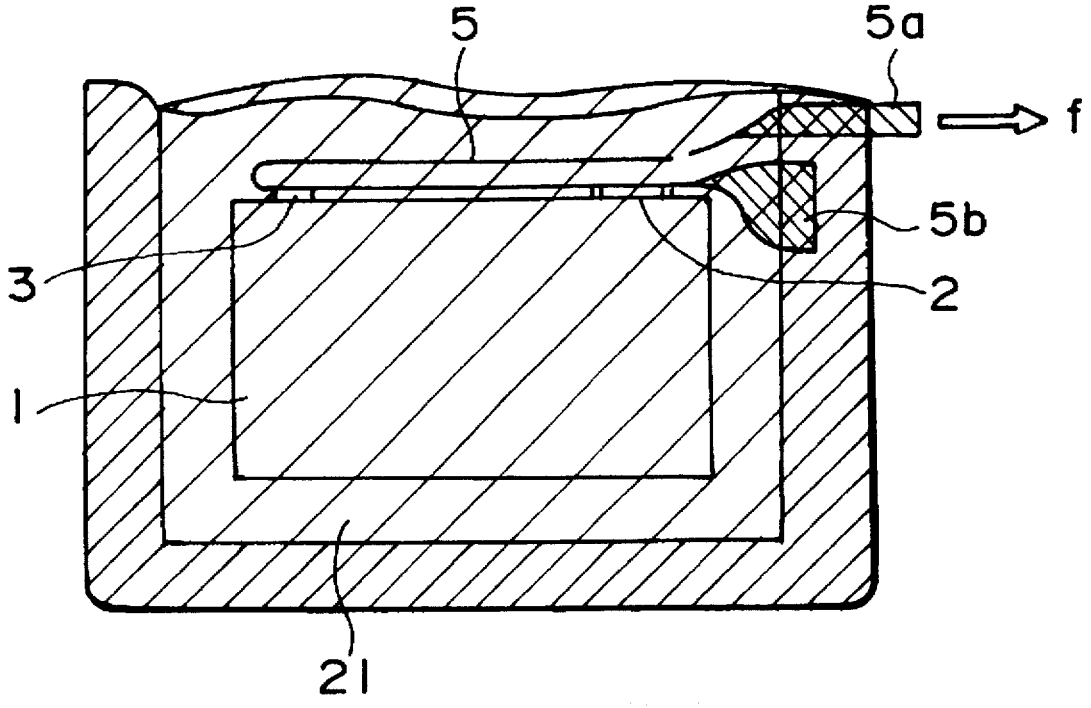
FIG. 15 illustrates a further example of a packing case containing a container cartridge.

Referring to FIG. 15, there is shown a further embodiment in which the order of removal (first the air vent 3, and then the ink supply port 2) of the sealing tape can be further preferably carried out. In this embodiment, a long sealing tape 5 is used the rest of the sealing tape 5 adjacent the portion sealing the air vent 3 is returned into the package and is extended to the outside of the package, and an end 5*b* of the sealing tape adjacent the portion sealing the ink supply port 2 is made integral with the package material 21.

When the package is opened, a part of the package 21 is opened, and then, the end 5*a* extended to the outside is pulled in a direction f. Then, the sealing tape is removed assuredly in the order of the air vent 3 and the ink supply port 2. Alternatively, before the package material 21 is opened, the sealing tape 5 is removed from the air vent 3 and the ink supply port 2 in the order named, and thereafter, the package 21 is opened. In this case, the sealing tape 5 may be further extended along the inside of the package 21 as a tear tape, as shown in FIG. 11, in which case the sealing tape 25 is continuous with the tear tape.

As regards the direction of removing the sealing tape from the opening of the container cartridge, it is preferable that the removal occurs at acute angle, since then the removal can be accomplished with smaller force.

Figure 16:
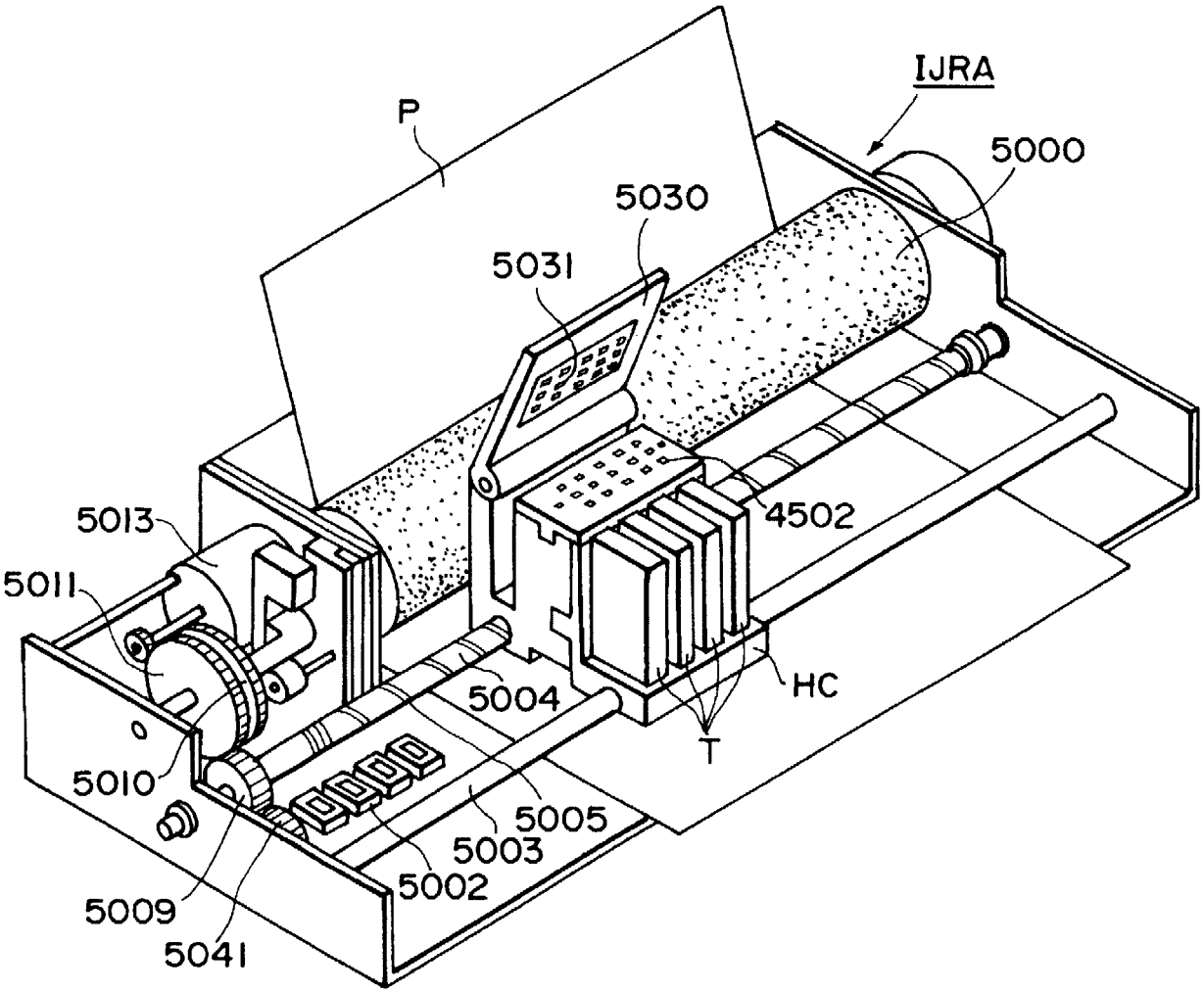
FIG. 16 is a perspective view of an example of an ink jet recording apparatus.

In the embodiment of FIG. 15, the direction of removal is close to 180 degrees. Referring to FIG. 16, there is shown in a perspective view an example of an ink jet recording apparatus IJRA usable with the container cartridge described in the foregoing.

According to the foregoing embodiments of the package case, the ink coming out of the container when the sealing tape is removed is discharged into the package case, and therefore, the discharged ink is of no problem. However, a combination of an embodiment of the ink container described hereinbefore and an embodiment of the package, is desirable since then only a small quantity of the ink is discharged into a package upon the unsealing, from the standpoint of additional reliability and saving sate of ink.

In this Figure, forward or backward rotation of a driving motor 5013 is transmitted to a lead screw 5004 through drive transmission gears 5011 and 5009 to rotate the lead screw 5004. A carriage HC is provided with a pin (not shown) engageable with a helical groove 5005 of the lead screw 5004 so that the carriage HC is reciprocated in a longitudinal direction of the apparatus. Designated by a reference numeral 5002 is a cap for capping a front side of each of recording heads in a recording head unit to be mounted on the carriage HC. It is used for recovery of the recording head, using unshown sucking means for sucking the ink out of the capped space. Each of the recording heads is provided with ejection outlets directed downwardly. Each recording head is connected with a container cartridge T. The cap 5002 is moved by a driving force transmitted thereto through a gear 5041 or the like so as to cap the ejection side surface of the recording head. Adjacent the cap 5002, there is provided an unshown cleaning blade for cleaning the ejection side surface of the recording head. The blade is supported for vertical movement in the FIG. As for the blade, any known cleaning blade is usable.

The capping, cleaning and sucking operations are carried out when the carriage HC has reached the home position by the lead screw 5005. However, they may be carried out at known proper timing.

Connection pads 4502 of the recording head unit mounted on the carriage HC are electrically connected with connection pads 5031 by rotation of a coupling plate 5030 of the carriage HC.

As described in the foregoing, according to the present invention, a volume of a space between a sealing material and an ink retaining material adjacent an ink supply port of the ink container, is reduced by the structure of the wall adjacent the ink supply port, so that the quantity of the ink stagnating in the space is significantly reduced. Therefore, the quantity of the ink scattered from the ink supply port upon removal of the sealing member, can be suppressed, and therefore, the operativity is improved.

According to another aspect of the present invention, the ink leakage or another inconvenience can be avoided during translation thereof alone, so that high reliability is assured with simple structure and low cost.

In addition, any user can easily open the package without scattering of the ink and contamination of the wear or hand thereby.

While the invention has been described with reference to the structures disclosed herein, it is not confined to the details set forth and this application is intended to cover such modifications or changes as may come within the purposes of the improvements or the scope of the following claims.

What is claimed is:

1. A package for accommodating a container cartridge having ink therein and provided with an ink supply portion and an air vent, the package comprising:

a package material for accommodating the container cartridge;

a sealing member for sealing the ink supply portion and the air vent of the container cartridge while the container cartridge is accommodated in the package material; and opening means for permitting opening of said package material for removal of the container cartridge therefrom, wherein at least part of said sealing member is mounted to said package material, and said opening means is positioned relative to said sealing member so that opening said package material by said opening means exposes only a portion of the container cartridge remote from said sealing member.

2. A package according to claim 1, wherein said opening means is a notch formed in a part of said package material for permitting opening of said package material by tearing at said notch.

3. A package according to claim 1, wherein said opening means is a perforation in said package material for permitting opening of said package material along said perforation.

4. A package according to claim 1, wherein said opening means is a tape in said package material for permitting opening of said package material by removing said tape.

5. A package according to claim 1, wherein said sealing material is in the form of a tape having two longitudinal ends, and at least one of said longitudinal ends is fused to the package material.

6. A package according to claim 1, wherein said sealing material for sealing the ink supply portion of the container cartridge comprises a tape having a first side and second side, said sealing being performed by an end portion of said first side and said second side being fused to the package material.

7. A package according to claim 1, wherein the package material is provided with an opening which is remote from said sealing member.

8. A package in combination with a container cartridge for accommodating the container cartridge, the container cartridge having ink therein and provided with an ink supply portion and an air vent, the package comprising:

a package material for accommodating the container cartridge;

a sealing member for sealing the ink supply portion and the air vent of the container cartridge while the container cartridge is accommodated in the package material;

opening means for permitting opening of said package material for removal of the container cartridge therefrom, wherein at least part of said sealing member is mounted to said package material, and said opening means is positioned relative to said sealing member so that opening said package material by said opening means exposes only a portion of the container cartridge remote from said sealing member; and said container cartridge, wherein the container cartridge has a wall thickness at the ink supply portion which is smaller than a thickness of a wall portion around the ink supply portion.

9. A package in combination with a container cartridge for accommodating the container cartridge, the container cartridge having ink therein and provided with an ink supply portion and an air vent, the package comprising:

a package material for accommodating the container cartridge;

a sealing member for sealing the ink supply portion and the air vent of the container cartridge while the container cartridge is accommodated in the package material;

opening means for permitting opening of said package material for removal of the container cartridge therefrom, wherein at least part of said sealing member is mounted to said package material, and said opening means is positioned relative to said sealing member so that opening said package material by said opening means exposes only a portion of the container cartridge remote from said sealing member; and said container cartridge, wherein the container cartridge contains an ink absorbing material which is deformed by its elasticity into the ink supply portion.

10. A package in combination with a container cartridge for accommodating the container cartridge, the container cartridge having ink therein and provided with an ink supply portion and an air vent, the package comprising:

a package material for accommodating the container cartridge;

a sealing member for sealing the ink supply portion and the air vent of the container cartridge while the container cartridge is accommodated in the package material;

opening means for permitting opening of said package material for removal of the container cartridge therefrom, wherein at least part of said sealing member is mounted to said package material, and said opening means is positioned relative to said sealing member so that opening said package material by said opening means exposes only a portion of the container cartridge remote from said sealing member; and said container cartridge, wherein the ink supply portion of the container cartridge is enclosed with a rib projecting outwardly.

11. A package in combination with a container cartridge for accommodating the container cartridge, the container cartridge having ink therein and provided with an ink supply portion and an air vent, the package comprising:

a package material for accommodating the container cartridge;

a sealing member for Sealing the ink supply portion and the air vent of the container cartridge while the container cartridge is accommodated in the package material;

opening means for permitting opening of said package material for removal of the container cartridge therefrom, wherein at least part of said sealing member is mounted to Said package material, and said opening means is positioned relative to said sealing member so that opening said package material by said opening means exposes only a portion of the container cartridge remote from said sealing member; and said container cartridge, wherein the air vent of the container cartridge is enclosed with a rib projected outwardly.

* * * * *

UNITED STATES PATENT AND TRADEMARK OFFICE

CERTIFICATE OF CORRECTION

PATENT NO. : 5,701,995

DATED : December 30, 1997

INVENTOR(S) : MASAHIKO HIGUMA ET AL.

It is certified that error appears in the above-identified patent and that said Letters Patent is hereby corrected as shown below:

COLUMN 3
Line 41, "illustrates" should read --illustrate--;
Line 48, "shows" should read --show--.

COLUMN 4
Line 65, "above described" should read --above-described--.

COLUMN 7
Line 35, "hang" should read --hung--.

COLUMN 8
Line 59, "sate of" should be deleted.

COLUMN 10
Line 9, "and" should read --and a--.

COLUMN 12
Line 1, "Sealing" should read --sealing--;
Line 8, "Said" should read --said--.

Signed and Sealed this

Eighth Day of September, 1998

*Attest:*

*Attesting Officer*

Bruce Lehman

BRUCE LEHMAN

*Commissioner of Patents and Trademarks*